US005957433A

United States Patent [19]

Fujikawa et al.

[11] Patent Number: 5,957,433

[45] Date of Patent: Sep. 28, 1999

[54] BELT HOIST INCLUDING A WINDING MEMBER WITH AN IMPROVED BELT FIXING SURFACE

[75] Inventors: Masaru Fujikawa; Koji Saai, both of Osaka, Japan

[73] Assignee: Elephant Chain Block Co., Ltd., Osaka, Japan

[21] Appl. No.: 08/891,826

[22] Filed: Jul. 14, 1997

[30] Foreign Application Priority Data

Jul. 31, 1996 [JP] Japan ..... 8-202499

[51] Int. Cl.[6] ..... B66D 1/30

[52] U.S. Cl. ..... 254/371; 254/333; 254/374; 254/DIG. 14

[58] Field of Search ..... 254/374, 333, 254/371, 373, DIG. 14; 242/586.1, 586.2

[56] References Cited

U.S. PATENT DOCUMENTS

| | | | |
|---|---|---|---|
| 1,408,425 | 2/1922 | Passavanti | 242/556.2 X |
| 3,297,303 | 1/1967 | Aizawa | 254/374 X |
| 4,688,765 | 8/1987 | Guangorena | 254/374 |
| 5,167,378 | 12/1992 | Johansen | 242/586.2 |
| 5,593,140 | 1/1997 | Van Beers | 254/374 |
| 5,647,551 | 7/1997 | Ikeda et al. | 242/586.2 X |

FOREIGN PATENT DOCUMENTS

| | | | |
|---|---|---|---|
| 1557761 | 12/1967 | France | 254/DIG. 14 |
| 6-25290 | 4/1994 | Japan . | |
| 1539165 | 1/1990 | U.S.S.R. | 254/373 |

*Primary Examiner*—Donald P. Walsh
*Assistant Examiner*—Emmanuel M. Marcelo
*Attorney, Agent, or Firm*—Dickstein Shapiro Morin & Oshinsky LLP

[57] ABSTRACT

A belt hoist for allowing fixture of a belt to a winding member to be strengthened to improve the reliability, with a simple structure. The winding member around which the belt is wound includes a shaft insertion bore at the center thereof; a belt fixing surface for allowing the belt to be fixed on a winding periphery; and a belt holder fitted on the belt fixing surface to press an end portion of the belt against the belt fixing surface. The belt fixing surface has a width not less than an inner diameter of the shaft insertion bore, and a fixing bore is so bored in the belt fixing surface as to escape from the shaft insertion bore, whereby the end portion of the belt is inserted in and fixed between the belt fixing surface and the belt holder by a fixing member fixed into the fixing bore.

4 Claims, 7 Drawing Sheets

BELT HOIST INCLUDING A WINDING MEMBER WITH AN IMPROVED BELT FIXING SURFACE

BACKGROUND OF THE INVENTION

1. Field of the Invention

The present invention relates to a belt hoist wherein a belt is wound around a winding member which is rotationally driven in a normal direction or in a reverse direction to raise or lower or drag a load through the belt.

2. Description of the Prior Art

As shown in FIG. 8 and disclosed by Japanese Laid-Open Utility Model Publication No. Hei 6(1994)-25290, a conventional type belt hoist is structured so that a flat belt B is wound around a winding member A having a shaft insertion bore A1 at the center thereof, with one end portion of the belt B fixed to a winding periphery of the winding member A and the other end portion thereof retaining a hanger for holding a load. For the winding of belt B around the winding member A, the winding member A is provided, on its outer periphery, with a generally L-shaped recess C comprising a stepped portion C1 extending radially inward from the outer periphery, and a belt fixing surface C2 extending from an inner end of the stepped portion C1 in the same direction as a coiling direction X of the belt B around the winding member A and having a width smaller than an inner diameter of the shaft insertion bore A1. In the belt fixing surface C2 of the recess C, a fixing bore D extending toward the shaft insertion bore A1 is bored. After the end portion of the belt B is fixedly mounted on the belt fixing surface C2 with a fastening screw E screwed into the fixing bore D, the free end side of the belt B is drawn out from the belt fixing surface C2 at the side opposite to the stepped portion C1 of the recess C in the same direction as the coiling direction X, and is wound around the winding member A.

When a load is raised up, the winding member A is rotated in the opposite direction to the coiling direction X of the belt B, to take up the belt B on the periphery of the winding member A so as to hoist up the load through the belt B. When the load is lowered down, the winding member A is rotated in the same direction as the coiling direction X of the belt B, to let out the belt B from the winding member A so as to lower down the load through the belt B.

When the load is raised or lowered, a large load acting in the same direction as the coiling direction X is exerted on the belt B. With the conventional type belt hoist described above, since the fixing bore D is bored in the belt fixing surface C2 to extend toward the shaft insertion bore A1 at the center of the winding member A, the depth of the fixing bore D is restricted by the length between the belt fixing surface C2 and the shaft insertion bore A1 and thus is inevitably of limited depth. Because of this, this conventional type belt hoist has a disadvantage that the fixture of the free end portion of the belt to the winding member cannot be well strengthened by use of the fastening screw E screwed into the fixing bore D.

SUMMARY OF THE INVENTION

Accordingly, the object of the present invention is to provide a belt hoist in which the connection between a belt and a winding member is strengthened in order to improve reliability.

A belt hoist according to the invention comprises a winding member around which a belt is wound, the winding member comprising a shaft insertion bore at the center thereof; a winding periphery for winding the belt thereon; a belt fixing surface for allowing the belt to be fixed on the winding periphery, the belt fixing surface having a width not less than an inner diameter of the shaft insertion bore; a belt holder fitted on the belt fixing surface to press an end portion of the belt against the belt fixing surface; and a fixing bore which is so bored in the belt fixing surface as to not contact the shaft insertion bore.

According to this invention, since a belt fixing surface has the width larger than the inner diameter of the shaft insertion bore and the fixing bore is so bored in the belt fixing surface as to escape from the shaft insertion bore, the depth and inner diameter of the fixing bore can be properly selected without being subjected to restrictions by the shaft insertion bore at the center of the winding member. Thus, the connection between the end portion of the belt and a fixing member situated in the fixing bore can be strengthened, thereby increasing the reliability of the belt hoist.

It is preferable in this case that the belt holder comprises (a) a belt holding portion having an insertion hole corresponding in position to the fixing bore and (b) a belt supporting portion continuously projecting from the belt holding portion and having a top portion which becomes substantially the same level as a trail of the belt coiled on the winding periphery of the winding member when the belt holder is fixed to fix the belt, in order that the profile of the belt coiled on the winding periphery of the winding member can be made substantially uniform over the entire outer periphery.

This construction, in which the belt holder is provided with the belt supporting portion whose top portion becomes substantially the same level as a trail of the belt coiled on the winding periphery of the winding member when the belt holder is fixed to fix the belt, allows the belt to be coiled in circle by simply winding the belt along the outer periphery of the winding member, thus achieving a smooth winding and unwinding of the belt.

It is desirable that the belt fixing surface is provided with a projection to apply resistance to slip to the belt fixed by the belt holder, in order that the belt fixed on the belt fixing surface can resist being slipped over the belt fixing surface by a load acting on the belt.

This provided projection contacted with the belt fixed to the belt fixing surface can apply resistance to slip to the belt to provide hard slip of the belt over the belt fixing surface when a straining force is exerted on the belt.

Further, it is advantageous that the winding member is provided, on its outer periphery, with a radially inward extending recess for applying resistance to slip to the belt, in order that the winding member can be made lightweight and also the belt wound on the outer periphery of the winding member can resist being slipped over the belt fixing surface.

The provision of the recess around the winding periphery provides the advantage that the winding member and thus the entire hoist can be made lightweight without decreasing in strength. Besides, sharpness of the recess can apply the resistance to slip to the belt to provide hard slip of the belt wound on the outer periphery of the winding member.

BRIEF DESCRIPTION OF THE DRAWINGS

The invention will now be described with reference to the accompanying drawings wherein.

DETAILED DESCRIPTION OF THE PREFERRED EMBODIMENT

Referring now to the accompanying drawing figures, an example of the preferred embodiment of the invention is described below. It is to be understood, however, that the scope of the invention is by no means limited to the illustrated embodiment.

Figure 6:
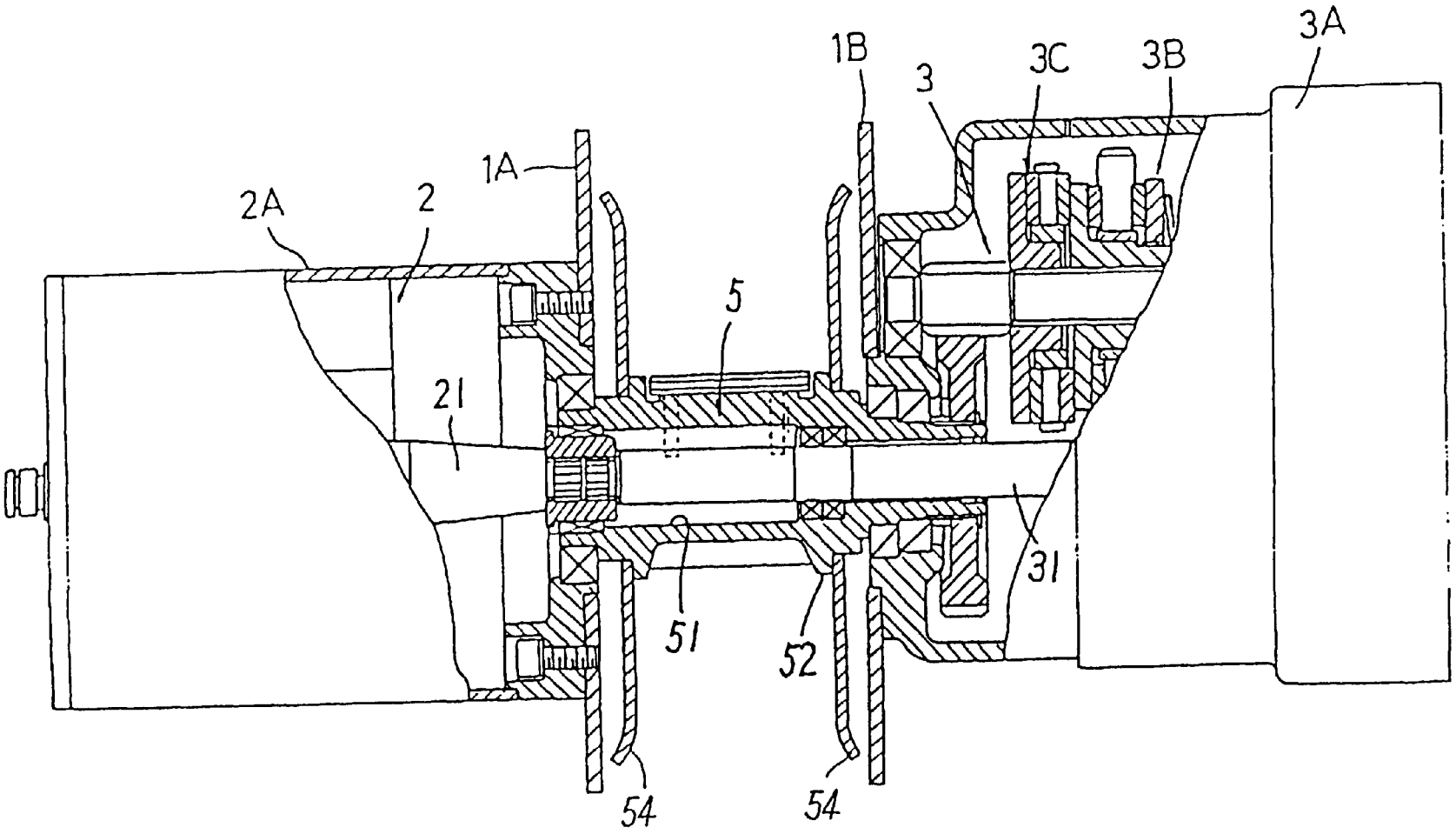
FIG. 6 is a partially broken, plan view of the belt hoist.
Figure 7:
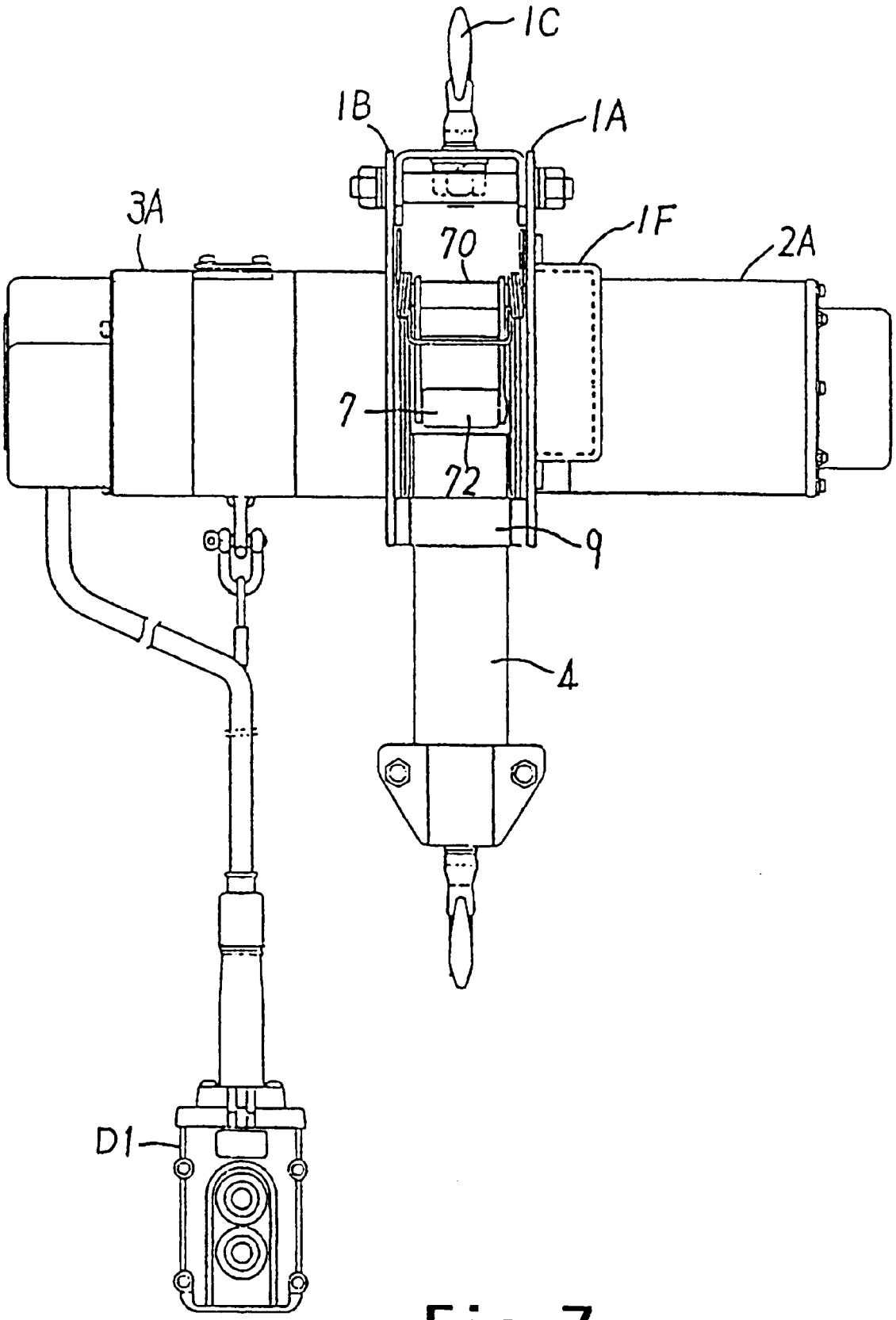
FIG. 7 is a rear view showing the entire structure of the belt hoist.
Figure 8:
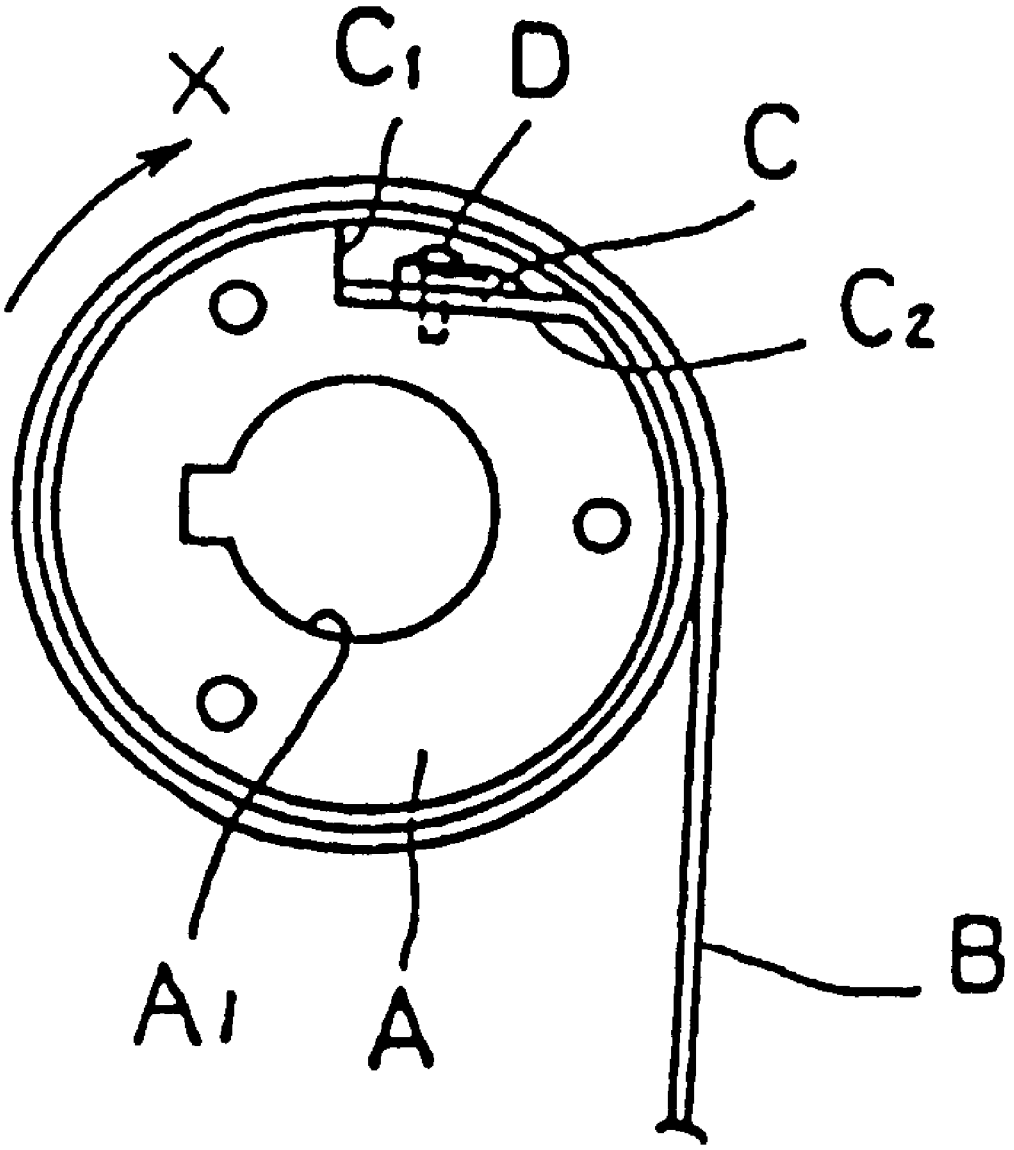
Fig. 8 PRIOR ART
FIG. 8 is an illustration of the prior art.

A belt hoist shown in FIGS. 6 and 7 comprises a pair of spaced apart, opposing first and second side plates 1A, 1B and a cylindrical winding member 5 having a shaft insertion bore 51 at the center thereof and a winding periphery 52 on the outer periphery at the lengthwise intermediate portion thereof and rotatably supported between the pair of side plates via a pair of bearings (not shown). In the shaft insertion bore 51 of the winding member 5, a drive shaft 31 is rotatably supported via a pair of bearings. At an outside of the first side plate 1A, a motor 2 having a motor shaft 21 connected with the drive shaft 31 and capable of rotating in a normal direction and in a reverse direction is disposed. The motor 2 forms a driving means. At an outside of the second side plate 1B, a reduction gear mechanism 3, including therein an over-loading prevent mechanism 3B and a mechanical brake 3C, for reducing rotational speed of the drive shaft 31 to a lower rotational speed to be transmitted to the winding member 5 is disposed. The drive of the motor 2 drives the winding member 5 to be rotated in the normal direction or in the reverse direction through the drive shaft 31 and the reduction gear mechanism 3. The motor 2 is covered with a cover 2A mounted on the first side plate 1A, and the reduction gear mechanism 3 is covered with a cover 3A mounted on the second side plate 1B.

Figure 2:
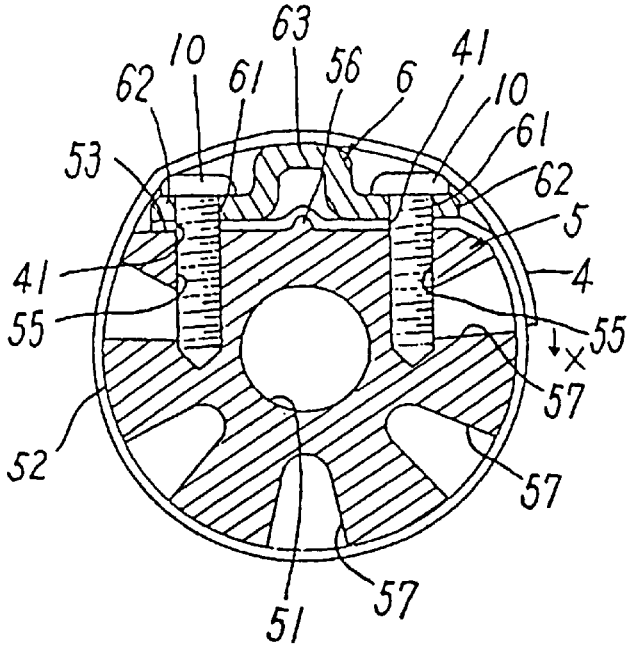
FIG. 2 is an enlarged sectional view of a winding member in the belt hoist.
Figure 3:
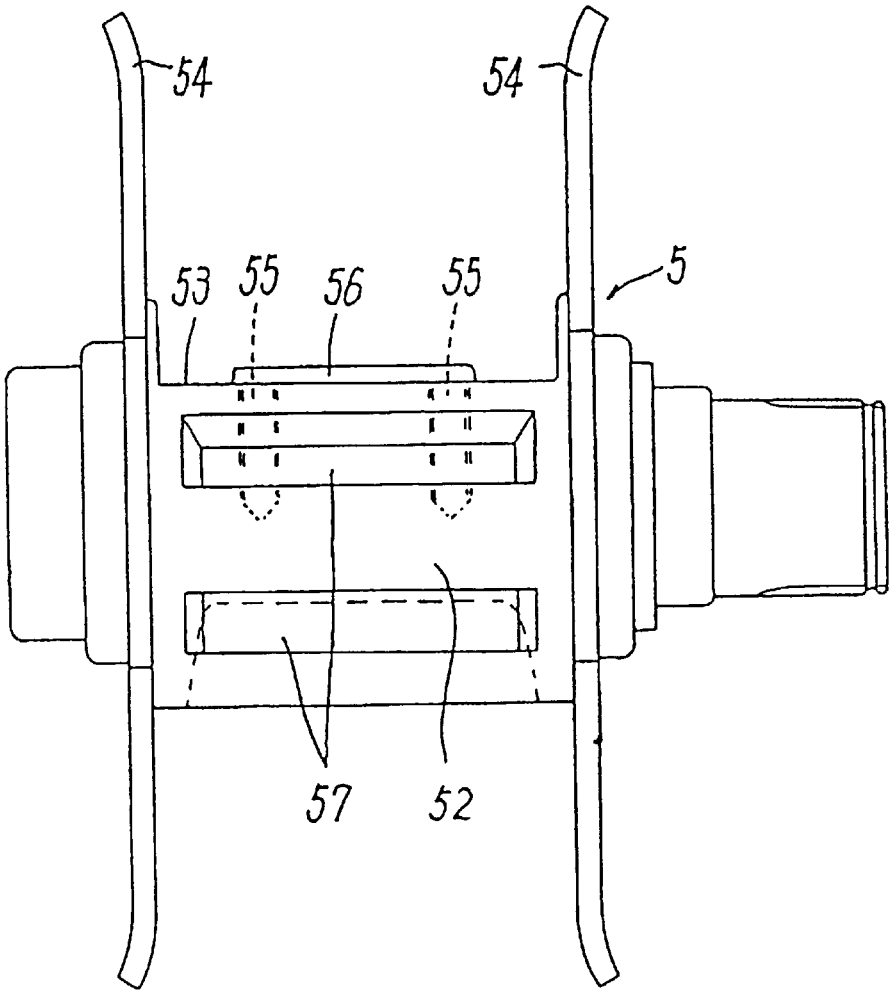
FIG. 3 is an enlarged rear view of the winding member.

The winding member 5 has a belt fixing surface 53, as shown in FIG. 2, which is formed by cutting off the winding periphery 52 of the winding member 5 levelly to extend over a length larger than the width of the belt. The belt 4 is fixed on the belt fixing surface 53 via a belt holder 6 fitted on the belt fixing surface 53 to press the end portion of the belt. Also, at opposite ends of the winding periphery 52, radially outwardly extending, disc-like flanges 54, 54 are mounted, and the belt 4 is coiled around the winding member 5 between the flanges 54, as shown in FIG. 3.

Figure 4:
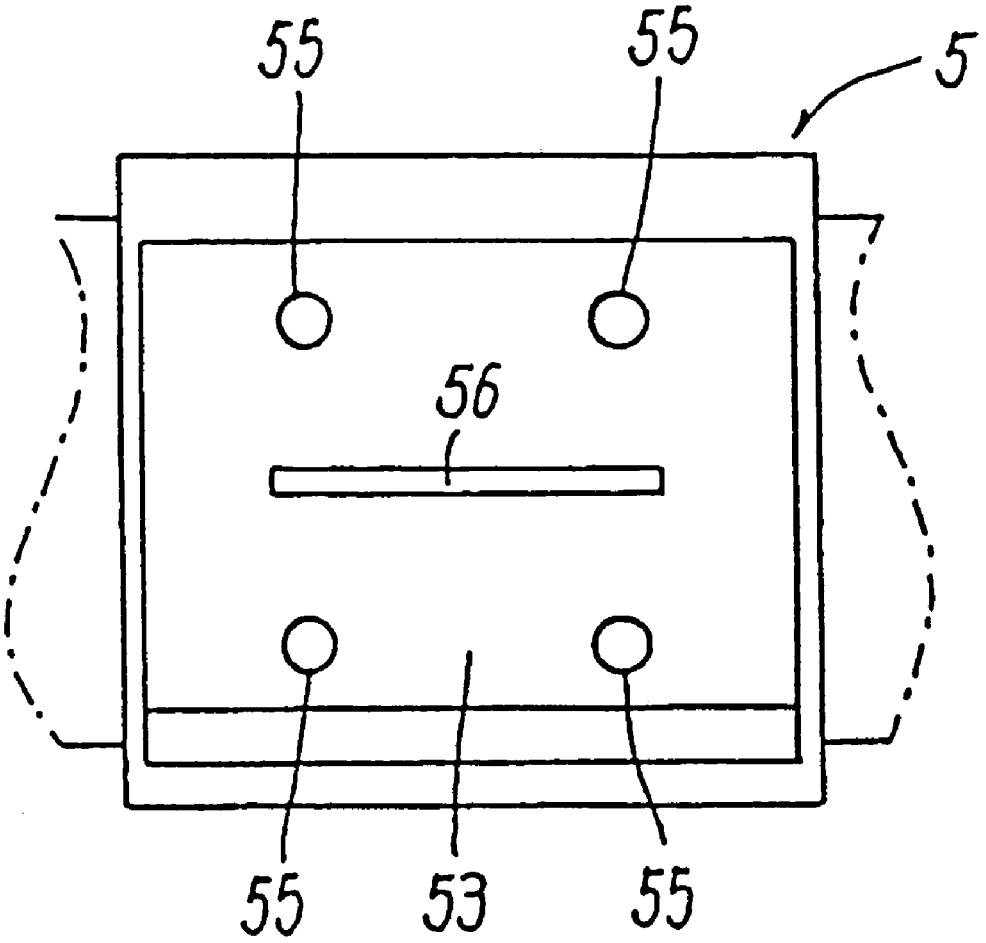
FIG. 4 is a plan view of only a belt fixing surface of FIG. 3.

The belt fixing surface 53 has a width larger than an inner diameter of the shaft insertion bore 51. At each end of the belt fixing surface 53, two fixing bores 55 are drilled in the winding member 5 so as not to come into contact with the shaft insertion bore 51. This is best shown with reference to FIGS. 2–4. At a portion between the bores 55, there is provided a projection 56 in the belt fixing surface 53 which provides resistance to prevent the belt 4 from slipping. The projection 56 may be formed by a plurality of projections, instead of the single convex projection used on the illustrated embodiments. Further, in the winding periphery 52, a plurality of recesses 57 which extend radially inwardly of the winding member and serve to apply a slip resistance to the belt 4 are formed along circumference of the winding periphery 52 at specific intervals.

The belt holder 6 has two, flat, belt holding portions 62 having four insertion holes 61 in total corresponding in position to the fixing bores 55 on the belt fixing surface 53, and a belt supporting portion 63 continuously projecting or rising up in the thickness direction thereof from the belt holding portions 62 and having a top portion which becomes substantially the same level as a trail of the belt coiled on the winding member 5 when the belt holder is fixed to the belt.

In the end portion of the belt 4 on the fixed side, four through holes 41 corresponding to the fixing bores 55 in the belt fixing surface 53 are bored. The end portion of the belt 4 on the fixed side is pressed and fixed by the belt holder 6 by tightening fastening screws 10 inserted in the insertion holes 61 of the belt holder 6 into the through holes 41 and screwably engaged into the fixing bores 55.

Now, when a heavy load is raised or lowered via the belt 4, the belt 4 is acted on by a large load acting in the same direction as the coiling direction X of the belt 4 being coiled around the winding member 5. With the belt hoist according to the invention, since the belt fixing surface 53 has the width larger than the inner diameter of the shaft insertion bore 51 and the fixing bore 55 is so bored in the belt fixing surface 53 so as to not contact the shaft insertion bore 51, the depth and inner diameter of the fixing bore 55 formed can be suitably selected without being subjected to restrictions by the shaft insertion bore 51 at the center of the winding member 5. This allows the fixing members, such as the fastening screws 10 fixed into the fixing bores 55, to have full length and diameter such that the fixture of the end portion of the belt by use of the fixing member can be well strengthened to increase the reliability of the belt hoist.

Further, since the belt holder 6 is provided with the belt supporting portion 63 whose top portion becomes substantially the same level as a trail of the belt coiled on the winding periphery of the winding member 5 when the belt holder is fixed to fix the belt, the belt can be coiled in circle by simply winding the belt along the outer periphery of the winding member, thus achieving a smooth winding and drawing of the belt. In addition, even when a load or force is straining the belt 4, the projection 56 on the belt fixing surface 53 which is in contact with the belt 4 fixed on the belt fixing surface 53 can apply resistance to slip to the belt to provide hard slip of the belt 4 over the belt fixing surface 53. Further, since the belt 4 wound on the winding periphery 52 engages in the recesses 57 in the winding periphery 52 and the sharpness of the recesses 57 applies the resistance to slip to the belt, the belt 4 can be made even harder to slip over the belt fixing surface 53.

Figure 1:
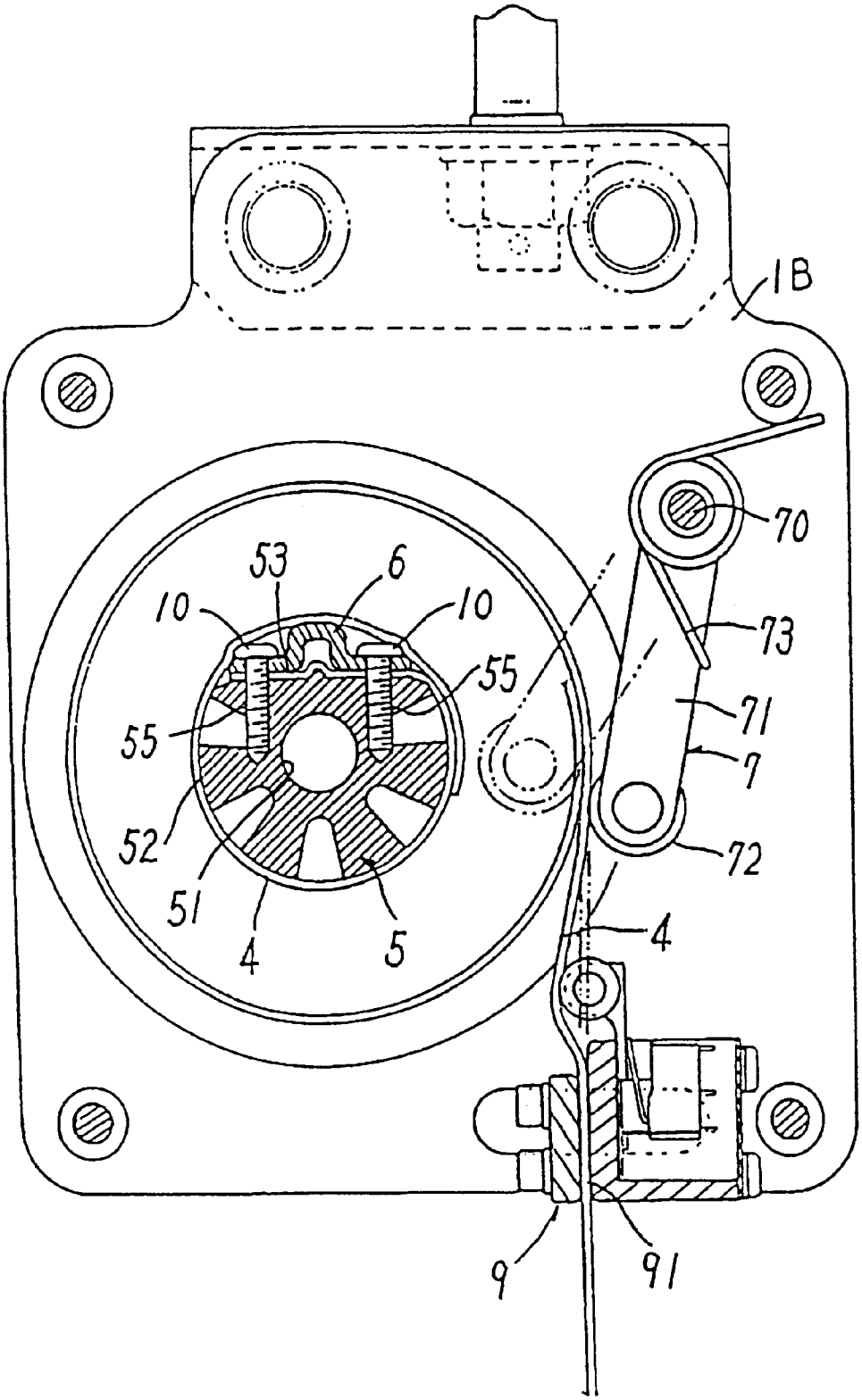
FIG. 1 is a vertically sectioned, side view of the belt hoist according to the invention.
Figure 5:
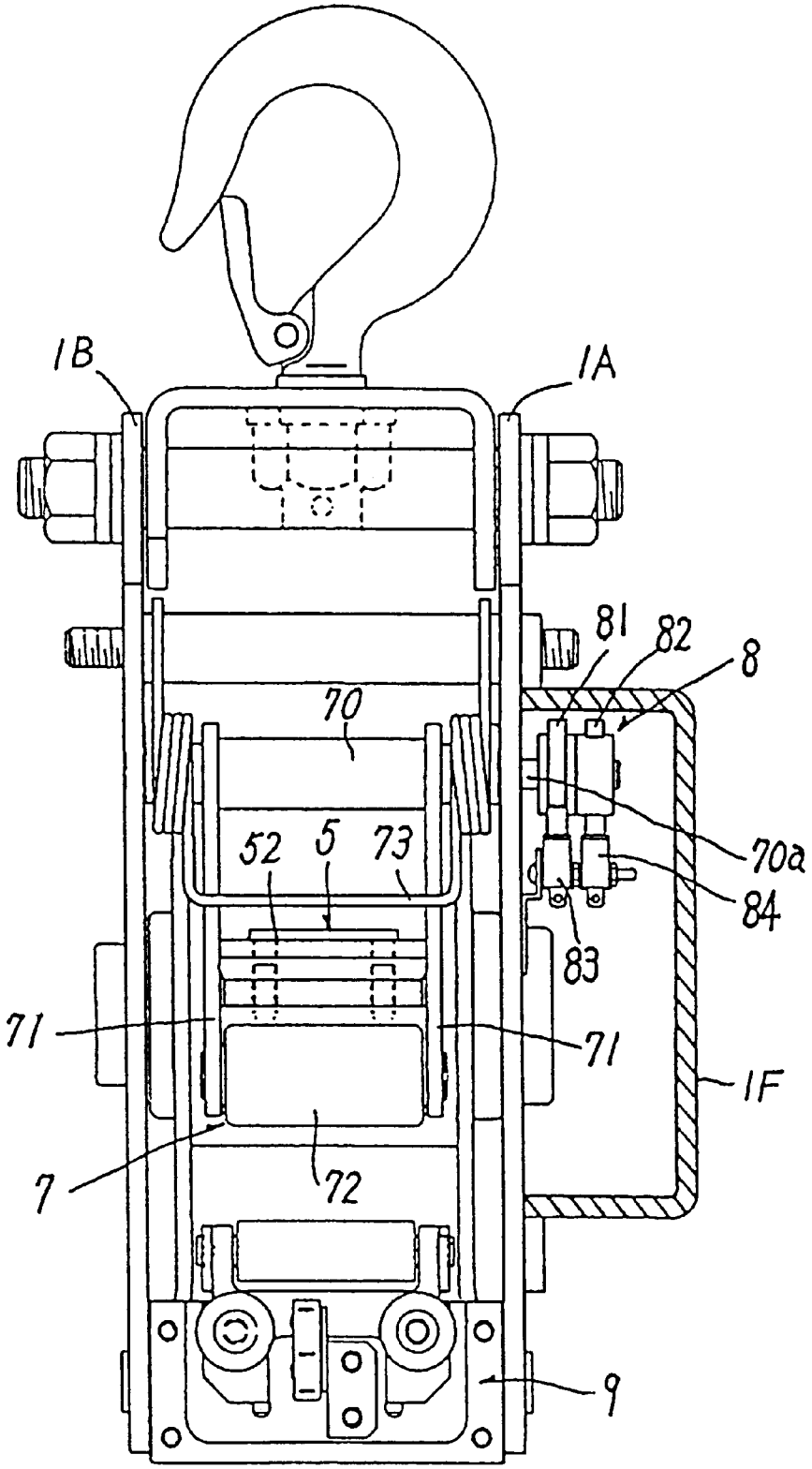
FIG. 5 is a partially cutaway, rear view of the belt hoist.

In the embodiment shown in FIGS. 1 and 5, a random coil preventing member 7 for normally pressing the belt 4 against the winding periphery 52 of the winding member 5 to prevent random coiling of the belt 4 is swingably supported on a pivot 70 between the first and second side plates 1A, 1B. Also, a control means 8 is provided for controlling the drive of the motor 2 by swinging motion of the random coil preventing member 7 in response to changes in circle diameter of the belt 4 wound around the winding member 5. Further, a belt guide 9 with a belt guide bore 91 is disposed below the random coil preventing member 7 in such a manner as to be movable in the same direction as the swinging direction of the random coil preventing member 7.

The random coil preventing member 7 comprises a pair of spaced apart, opposing arms 71, 71 which are mounted on the pivot 70 rotatably supported between the first and second side plates 1A, 1B; a rotary element 72 composed of a roller which is rotatably supported to the arms 71 at the front end portion thereof via bearing means and is contactable with the belt 4; and a biasing spring 73 for biasing the arm 71 toward the outer periphery of the winding member 5 so that the rotary element 72 can be normally pressed against the belt 4.

The control means 8 is provided in the following way. One lengthwise end portion 70*a* of the pivot 70 is projected outward from the side plate 1A. First and second protrusions 81, 82, each being formed by protruding one end portion of a boss having a fitting bore outward, are arranged on the projected end portion 70*a* with a specified phase difference in the circumferential direction and are secured thereto by screws so as to be changeable in position. As depicted in a two-dot chain line in FIG. 1, at positions near the projected end portion 70*a* and on swinging paths along which the first and second protrusion 81, 82 movable in response to the turning of the pivot 70 are swung, first and second detection switches 83, 84 are so arranged as to be adjustable in position, respectively. The first detection switch 83, which is formed by a limit switch and the like, is brought into contact with the first protrusion 81 to stop the drive of the motor 2 when length of the belt 4 wound around the winding member 5 decreases with the lowering of the belt 4 and circle diameter of the belt 4 decreases below a specified circle diameter. The second detection switch 84, which is formed by a limit switch and the like, is brought into contact with the second protrusion 82 to stop the drive of the motor 2 when the length of the belt 4 wound around the winding member 5 increases with the winding of the belt 4 and the circle diameter of the belt 4 increases over a specified circle diameter. In the illustrated embodiments, at the outside of the side plate 1A, a cover 1F for covering the protrusions 81, 82 and the detection switches 83, 84 is detachably attached to the side plate 1A with fastening screws.

Further, as shown in FIG. 7, a hanging member 1C composed of a hook is mounted between the side plates 1A, 1B at the top and a controlling unit 1D for controlling the winding member 5 to be rotated in the normal direction or in the reverse direction is connected with the cover 3A.

What is claimed is:

1. A belt hoist comprising:

winding member around which a belt is wound, said winding member comprising a shaft insertion bore at the center thereof;

a winding periphery for winding said belt thereon;

a belt fixing surface for allowing said belt to be fixed on said winding periphery, said belt fixing surface having a width greater than an inner diameter of said shaft insertion bore;

a belt holder fitted on said belt fixing surface to press an end portion of said belt against said belt fixing surface; and, a fixing bore which is bored in said belt fixing surface so that a center line of the fixing bore does not intersect with any portion of the shaft insertion bore.

2. The belt hoist according to claim 1, wherein said belt holder comprises:

a belt holding portion having an insertion hole corresponding in position to said fixing bore and which confronts the belt fixing surface in the area of the winding member between the shaft insertion bore and the winding periphery; and, a belt supporting portion projecting from said belt holding portion and having a top portion which is located at substantially the same level as an end of the belt coiled on said winding periphery of said winding member.

3. The belt hoist according to claim 1, wherein said belt fixing surface is provided with a projection to apply resistance to slip to said belt fixed by said belt holder.

4. The belt hoist according to claim 1, wherein said winding member is provided, on its outer periphery, with a radially inward extending recess for applying resistance to slip to said belt.

* * * * *